US010487547B2

(12) United States Patent
Malvy et al.

(10) Patent No.: US 10,487,547 B2
(45) Date of Patent: Nov. 26, 2019

(54) SYSTEM FOR CONTROLLING THE OPENING OF AN OPENABLE BODY SECTION OF A MOTOR VEHICLE

(71) Applicants: PSA Automobiles SA, Poissy (FR); U-SHIN DEUTSCHLAND ZUGANGSSYSTEME GMBH, Erdweg (DE)

(72) Inventors: Thomas Malvy, Athesans Etroitefontaine (FR); Régis Grenouillat, Dachau (DE)

(73) Assignees: PSA Automobiles SA, Poissy (FR); U-Shin Deutschland Zugangssysteme GmbH, Erdweg (DE)

( * ) Notice: Subject to any disclaimer, the term of this patent is extended or adjusted under 35 U.S.C. 154(b) by 0 days.

(21) Appl. No.: 16/318,677

(22) PCT Filed: Jun. 9, 2017

(86) PCT No.: PCT/EP2017/064106
§ 371 (c)(1),
(2) Date: Jan. 17, 2019

(87) PCT Pub. No.: WO2018/015065
PCT Pub. Date: Jan. 25, 2018

(65) Prior Publication Data

US 2019/0284847 A1 Sep. 19, 2019

(30) Foreign Application Priority Data

Jul. 22, 2016 (FR) ..... 16 57035

(51) Int. Cl.
*E06B 3/00* (2006.01)
*E05B 81/56* (2014.01)
(Continued)

(52) U.S. Cl.
CPC ..... *E05B 81/56* (2013.01); *E05B 81/06* (2013.01); *E05B 85/107* (2013.01); *E05Y 2900/531* (2013.01)

(58) Field of Classification Search
CPC ..... E05B 81/56; E05B 81/06; E05B 85/107; E05Y 2900/531
(Continued)

(56) References Cited

U.S. PATENT DOCUMENTS 8,443,553 B1 * 5/2013 Polewarczyk ..... E05B 81/77 16/412
2011/0148575 A1 * 6/2011 Sobecki ..... E05B 85/103 340/5.64
(Continued)

FOREIGN PATENT DOCUMENTS

DE 102012023792 A1 6/2014
DE 102013112120 A1 * 5/2015 ..... E05B 77/02
(Continued)

OTHER PUBLICATIONS

International Search Report for PCT/EP2017/064106 dated Aug. 9, 2017.
Written Opinion for PCT/EP2017/064106 dated Aug. 9, 2017.

*Primary Examiner* — Jerry E Redman
(74) *Attorney, Agent, or Firm* — Sandberg Phoenix & von Gontard P.C.

(57) ABSTRACT

The invention relates to a system for controlling the opening (4) of a motor vehicle door (2). The system (4) comprises: a housing (8); a handle (6) pivoting relative to the housing (8); an electric motor (18) for retracting and extending the handle of the openable body section; and a computer (22) which controls the power supply of the motor (18), and which switches from a standby mode to an active mode when the handle (6) is moved. The electric motor (18) generates a wake-up voltage during the movement of the
(Continued)

handle (6) relative to the housing (8). The computer (22) is configured to switch from standby mode to active mode when it receives the wake-up voltage generated by the motor (18). Waking only takes place when the wake-up voltage reaches a threshold S of 5 mV.

11 Claims, 2 Drawing Sheets

(51) Int. Cl.
*E05B 85/10* (2014.01)
*E05B 81/06* (2014.01)

(58) Field of Classification Search
USPC ..... 49/503
See application file for complete search history.

(56) References Cited

U.S. PATENT DOCUMENTS

2013/0076047 A1* 3/2013 Wheeler ..... E05B 85/00 292/336.3
2013/0076048 A1* 3/2013 Aerts ..... E05B 85/103 292/336.3
2013/0127185 A1* 5/2013 Lang ..... E05B 81/77 292/336.3
2014/0047877 A1* 2/2014 Bohm ..... E05B 85/107 70/275
2016/0222702 A1* 8/2016 Koizumi ..... E05B 81/77
2016/0369537 A1* 12/2016 Rocci ..... E05B 85/107
2017/0292297 A1* 10/2017 Bartels ..... E05B 85/107
2017/0370123 A1* 12/2017 Papanikolaou ..... B60J 5/04
2018/0106082 A1* 4/2018 Brown ..... E05B 85/107
2018/0148957 A1* 5/2018 Och ..... E05B 81/76
2018/0171686 A1* 6/2018 Couto Maquieira ..... E05B 85/107
2018/0252005 A1* 9/2018 Magner ..... E05B 81/77
2019/0048645 A1* 2/2019 Nakatomi ..... E05F 15/75
2019/0178013 A1* 6/2019 Toyama ..... B60R 1/00
2019/0186180 A1* 6/2019 Iwata ..... E05B 85/06
2019/0211592 A1* 7/2019 Bextermoller ..... E05B 85/107

FOREIGN PATENT DOCUMENTS

DE 102014114799 A1 * 4/2016 ..... B60L 58/14
EP 0816597 A1 1/1998
EP 3020892 A1 * 5/2016 ..... E05B 79/04
GB 2536672 A * 9/2016 ..... E05B 81/90
JP 2005155126 A 6/2005
WO 2007121817 A1 11/2007
WO 2015073119 A1 5/2015
WO WO-2017198921 A1 * 11/2017 ..... E05B 81/76
WO WO-2018015065 A1 * 1/2018 ..... E05B 81/76

* cited by examiner

SYSTEM FOR CONTROLLING THE OPENING OF AN OPENABLE BODY SECTION OF A MOTOR VEHICLE

CROSS-REFERENCE TO RELATED APPLICATIONS

This application is the U.S National Stage under 35 USC § 371 or International App. No. PCT/EP2017/064106 filed 9 Jun. 2017, which claims priority to French App. No. 1657035, filed 22 Jul. 2016, both of which are incorporated herein by reference.

BACKGROUND

The invention relates to the field of external controls for opening openable body sections. More specifically, the invention relates to the waking-up of a control system that is initially in a standby mode. The invention relates to a system for controlling the opening of an openable body section. The invention also proposes a method for waking a system for controlling the opening of an openable body section. The invention also relates to a motor vehicle.

A control for opening an openable body section of a motor vehicle generally comprises an electric motor for moving an openable body section of the vehicle between an open position and a closed position. The motor moves the openable body section one way or the other in response to the manipulation of its outer opening control handle.

JP 2005-155126 A discloses a motor vehicle equipped with a motorized sliding door. When the handle of the door is manipulated, the motor begins to open or close the door as appropriate. In order to save energy, the power supply is cut off temporarily. As soon as the door handle is pressed, it engages a switch that allows the motor to be powered in order to drive the door. The motor limits the closing torque that it exerts on the openable body section when the presence of an intrusion in contact with the openable body section has been detected. In addition, cases of incorrect detection are recognized. For this purpose, the motor is associated with a door motor driver, an electrical current detection circuit, and a computer with a computer program. This solution optimizes safety by avoiding pinching an individual. However, its cost remains high, and its operation requires the switch to be live.

SUMMARY

It is the object of the invention to solve at least one of the problems posed by the prior art. More specifically, the invention aims to reduce the cost of a system for controlling the opening of an openable body section. It is also the object of the invention to simplify such a system while optimizing its reliability and sensitivity.

A system is disclosed for controlling the opening of an openable body section, particularly a vehicle door. The system comprises a housing, a handle that can be moved relative to the housing, an electric motor, and a computer that is configured so as to switch from a standby mode to an active mode. The electric motor is designed to generate a wake-up voltage TR when the handle is moved relative to the housing, the computer being configured to switch from the standby mode to the active mode when it receives the wake-up voltage TR generated by the motor.

According to particular embodiments, the system may comprise one or more of the following features, taken separately or in any possible technical combination:

- The computer is configured to wake up when the wake-up voltage TR generated by the motor exceeds a threshold S.
- The threshold S is less than or equal to 20 mV or 5 mV.
- The system includes a voltage rectifier produced by the motor. The computer comprises an electric filter that is designed to filter the wake-up voltage TR coming from the motor, and/or a voltage amplifier that is designed to amplify the wake-up voltage TR coming from the motor.
- The computer is configured to control the power supply of the motor so that it provides mechanical work.
- The motor is designed to move the handle relative to the housing, particularly between a retracted position and an extended position.
- The motor is designed to generate a wake-up voltage when the handle is pushed toward the housing and/or away from the housing.
- The motor comprises an electromagnetic coil and a permanent magnet that can be moved relative to one another.
- The threshold S and/or the wake-up voltage is less than or equal to 500 mV, 100 mV, or 20 mV.
- The threshold S and/or the wake-up voltage is/are greater than or equal to 5 mV, or 10 mV, or 50 mV.
- The motor is coupled with the handle.
- The motor is a generator.
- The motor is connected to the computer.
- The handle is a pivoting handle.
- The electric motor is configured to function as a voltage generator that generates the wake-up voltage when the handle is moved relative to the housing and/or relative to the openable body section.
- The electric motor comprises a stator and a rotor, the coil being connected to the stator and each magnet being connected to the rotor, or the coil being connected to the rotor and each magnet being connected to the stator.
- The motor comprises a mechanical reducer, particularly with gears.
- The system is configured such that the voltage generated by the motor is generally proportional to the speed of the movement of the handle.

The invention also relates to a method for waking and/or activating a system for controlling the opening of an openable body section, the openable body section comprising an electric motor and a handle that can be moved between at least a first position and a second position, with the method comprising the following steps: (a) the system is in a standby mode; (b) the handle is moved; (c) the system is switched to an active mode; characterized in that the electric motor is coupled with the handle such that it can function as a voltage generator, thus generating a wake-up voltage when the handle is moved during step (b), and with the system being configured so as to switch from system step (a), in which the system is in the standby mode, to system step (c), in which the system is in the active mode when it detects a wake-up voltage generated by the motor.

The invention also relates to a vehicle, particularly an automobile, comprising an openable body section with a handle and a system for controlling the opening of an openable body section, characterized in that the system is in keeping with the invention, the vehicle comprising a master computer that communicates with the computer of the system for controlling an openable body section when it is active.

According to a particular embodiment, the vehicle comprises a power supply that is capable of supplying the motor with power, the power supply being cut off from the computer and/or the motor when the system is in standby mode.

According to a particular embodiment, the vehicle comprises a master computer that communicates with the control computer when the latter is in active mode.

In general, the specific embodiments of each object of the invention are also applicable to the other objects of the invention. Insofar as possible, each object of the invention can be combined with other objects.

The invention makes it possible to simplify the system, since it uses the motor that is already present in the openable body section. It utilizes its capacities to generate a current or voltage in response to a movement caused by a user. Since the system dispenses with a switch, it offers savings in terms of this element, the connections, and any control it might otherwise have.

The system offers great flexibility of detection, because voltage is produced from the moment the handle is actuated. Therefore, the mode change can be brought about with a reduced range of motion and very early in the movement of the handle. Moreover, a wake-up signal is produced in one of the directions of movement, and optionally in both directions of movement. For example, a positive voltage can be generated when the handle is pushed. Optionally, a negative voltage may be generated when the handle is pulled.

Electrically passive operation is preferred in the context of the system. Independently of a possible DC power supply, the movement of the magnets produces sufficient voltage upon the waking of the control computer to monitor the state of the system. The system becomes simpler and more energy efficient.

DESCRIPTION OF THE FIGURES

Other features and advantages of the system will be better understood from the description, which is provided for the sake of example with reference to the drawings, in which.

DETAILED DESCRIPTION

Figure 1:
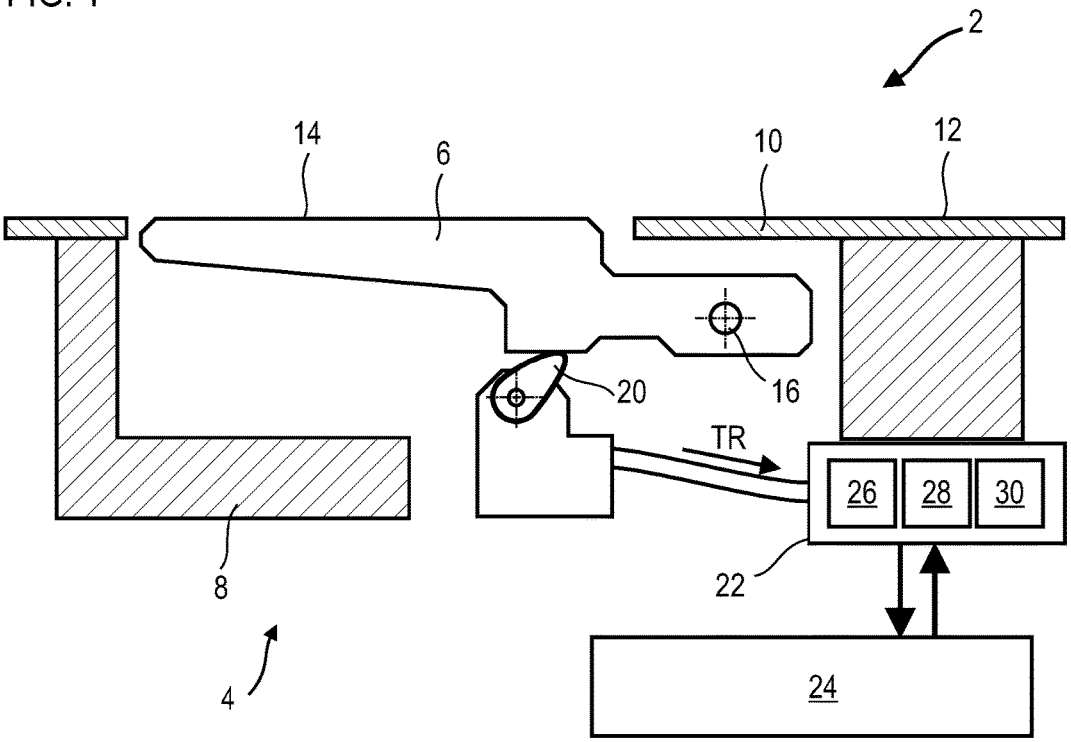
FIG. 1 shows a system for controlling an openable body section; with a handle is in a first retracted position, and the system in a standby mode.

FIG. 1 shows a sectional view of a portion of the openable body section 2 of a vehicle. In the present case, the openable body section is a door of a motor vehicle. The openable body section could also be a trunk lid of the vehicle.

The openable body section 2 has an opening control system 4 with a handle 6, the handle being external, for example. The handle 6 is mounted so as to be movable relative to a housing 8, also called a stirrup, that is arranged within the thickness of the openable body section 2. The handle 6 is shown here in a rest position in which it is flush with a body panel 10 specific to the openable body section 2. It is in a first retracted position. The outer surface 12 of the openable body section 2 can be flush with the outer surface 14 of the handle.

The handle 6 is mounted so as to be pivotable relative to the housing 8 and hence in relation to the openable body section 2. As an alternative, it could be translationally movable or follow any other appropriate kinematics. The handle 6 is articulated with the aid of a swivel pin 16 around which it rotates. It can be pulled out and thus extended from the openable body section 2 and protrude from the outer surface 12 thereof or retracted into a second retracted position. These kinematics will be described in greater detail with reference to the next figures.

The opening control system 4 comprises an electric motor 18. The motor 18 is a dynamoelectric machine. This motor 18 moves the handle 6, e.g., from the first retracted position to a first extended position. The motor can also move the handle 6 in the reverse direction in order to return the handle 6 to the first retracted position, or rest position. The motor 18 can comprise a swing arm 20, or a connecting rod, that pushes the handle 6. Optionally, the system 4 can comprise return means (not shown), for example a spring, that brings the handle 6 into contact with the arm 20. A reducer (not shown) makes it possible to reduce the rotational speed of the rotor of the motor 18 relative to that of the arm 20.

The system 4 further comprises a computer 22 that controls the electrical power received by the motor 18. The control computer 22 can comprise one or more electrical circuits. It is connected to the master computer 24 of the vehicle, also called main computer. The control computer 22 is connected to the power supply of the vehicle and manages the electrical energy that is converted into mechanical energy by the motor 18 in order to move the handle 6 between the first retracted position and the first extended position. The control computer 22 can be placed in the openable body section 2, e.g., in the housing 8.

The motor 18 can also perform the energy conversion in the reverse direction. It can convert mechanical energy that is received into generated electrical energy. It then operates as a voltage generator. For example, when the handle 6 is actuated by a user, the motor 18 produces an electric potential. For this purpose, the motor has a rotor and a stator. Both can be sets of coils; for example, one of the sets can be powered to produce a variable magnetic field while the other receives the variable magnetic field and converts it into voltage. Or the rotor of the motor 18 may have a plurality of permanent magnets that create a current in the coils of the rotor, a voltage. When a voltage is produced, it is sent to the control computer 22.

The opening control system 4 can comprise a voltage rectifier 26 that is optionally integrated into the control computer 22 or the motor 18. This voltage rectifier 26 makes it possible to transform voltage peaks originating from the motor 18. It can produce a direct voltage or a square wave signal. The control computer 22 can also comprise a voltage amplifier 28. It amplifies the voltages coming from the motor 18 and, optionally, from the voltage rectifier 26. This makes it possible to adapt to the voltage drop related to the electrical resistance of the electrical circuit of the control computer 22. The latter can also comprise an electric filter 30 for recognizing cases in which the voltage produced by the motor 18 exceeds a threshold S. This verification can be carried out directly at the terminals of the motor 18, or optionally at the level of the amplified voltage from the voltage amplifier 28.

In order to save electric power, the control computer 22 can be in standby mode and no longer be powered by the vehicle. Its waking, which signifies a switch to active mode, can be triggered by the motor 18 when it produces a voltage greater than the threshold S, also called wake-up voltage TR.

According to an alternative embodiment, the motor comprises a finger that comes out and returns linearly into the body of the motor. This means that the motor is not necessarily a rotary actuator. The motor can be a magnet that moves translationally in or near a coil. It can also comprise a capacitor with mobile electrodes.

Figure 2:
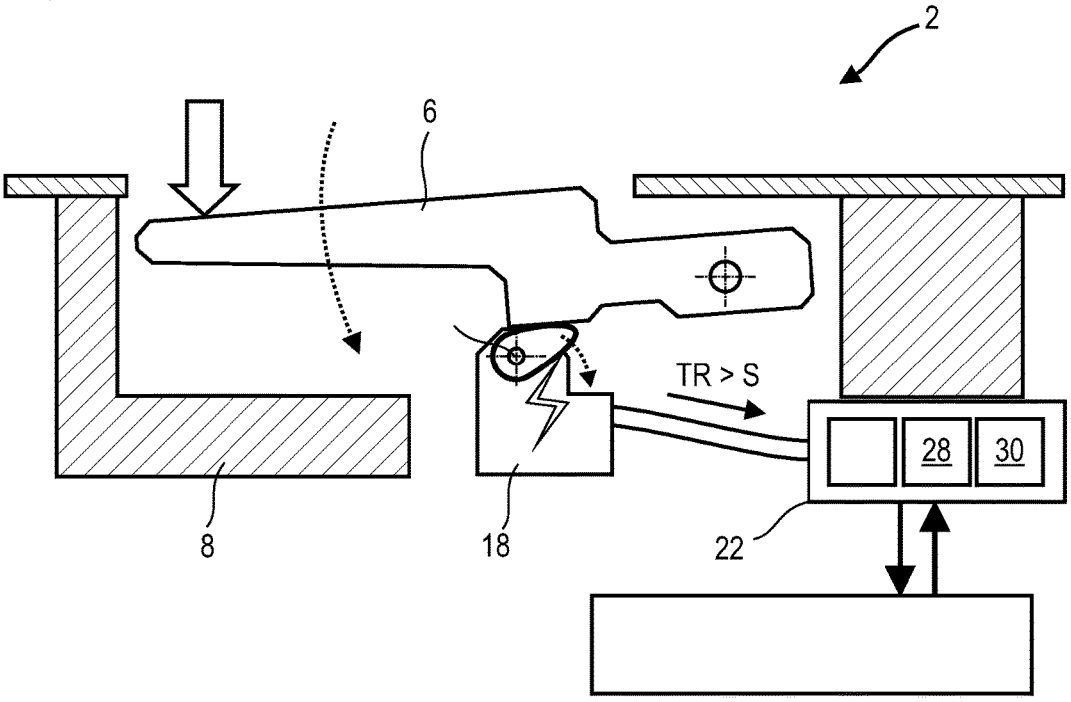
FIG. 2 illustrates the system for controlling an openable body section in active mode following the movement of the handle to a second retracted position.

FIG. 2 shows the portion of the openable body section 2 of FIG. 1, but with the control computer 22 in active mode.

The handle 6 has been moved from the first retracted position to the second retracted position. It has been pressed into the housing 8. By means of this movement, the motor 18 has produced a wake-up voltage TR that is greater than or equal to the threshold S. The threshold S can be greater than or equal to 10 mV. The threshold S can be of the order of 50 mV. The threshold S can be chosen so as to ignore the noise. The voltage amplifier 28 can multiply the voltage from the motor 18 by twenty or a hundred. From then on, the voltage analyzed by the electric filter 30 may be greater than or equal to 0.5 V.

In summary, since the wake-up voltage TR from the motor 18 has reached or exceeded the threshold S, the control computer 22 becomes active.

Figure 3:
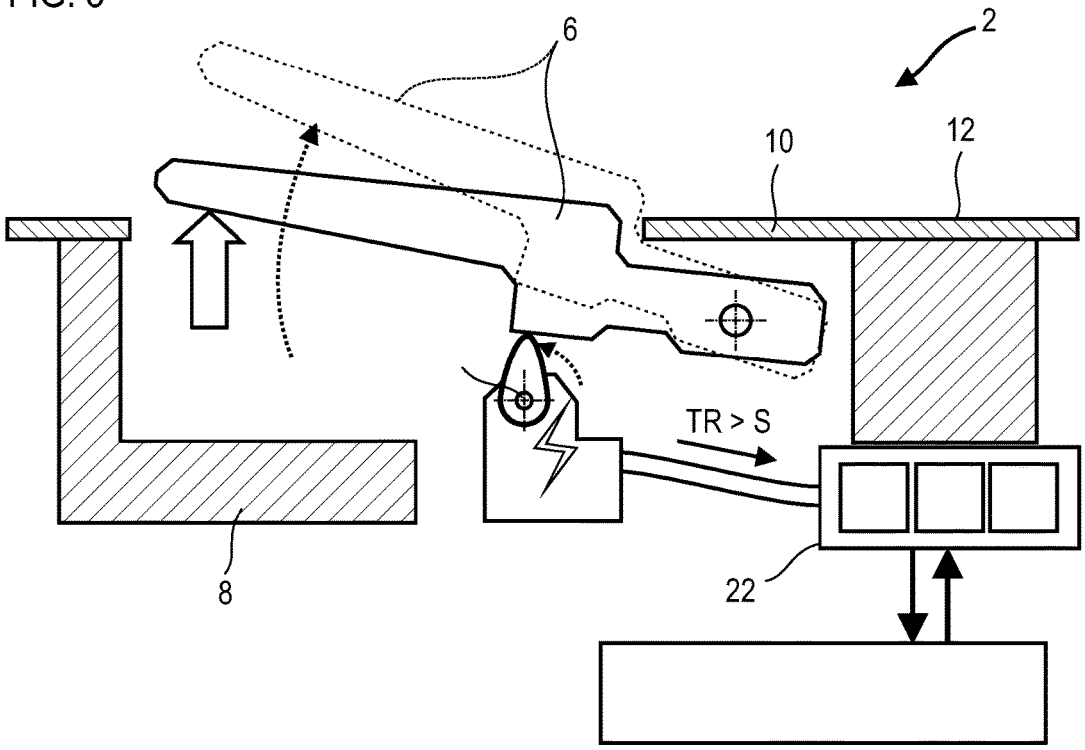
FIG. 3 shows the system for controlling an openable body section in active mode following the tilting of the handle into a first extended position.

FIG. 3 shows the portion of the openable body section 2 of FIG. 1, but with the control computer 22 in active mode.

The phenomenon is similar to that described in FIG. 2; however, the handle 6 has been moved in the other direction from the first retracted position of FIG. 1. The handle 6 has been pulled into the first extended position, projecting out of the housing 8. It protrudes with respect to the panel 10, and particularly with respect to its outer surface 12. The handle 6 can still be pulled into a second extended position (shown in dotted lines). This second position enables the openable body section 2 to be unlocked, for example.

Figure 4:
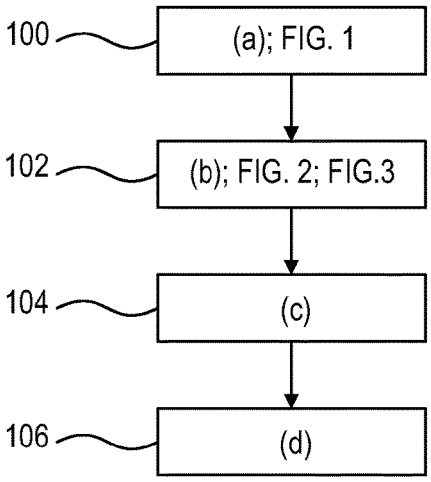
FIG. 4 is a diagram of the method for waking and/or activating the system according to the invention for controlling an openable body section.

FIG. 4 shows a schematic diagram of the waking of the system for controlling an openable body section. The system and the openable body section may correspond to those described in relation to FIGS. 1 to 3. The method can be an activation method.

The wake-up method can comprise the following steps, optionally in the following order:

(a) the system, particularly control computer, is in standby mode 100;

(b) the handle 102 is moved and leading to rotation of the motor, which results in the generation of a wake-up voltage that is received by the system, the wake-up voltage being greater than or equal to the threshold S;

(c) the system, particularly control computer, is in active mode 104;

(d) communication 106 between the control computer and the master computer, this step being optional.

Following the waking of the system during step (c) active mode 104, also called step (c) activation, the control computer and the master computer initiate a communication protocol. The control computer can send a mode change message via an electrical network of the vehicle. The master computer can then check for the presence of the vehicle owner by sending a radio message to a receiver key or an electronic card. In the absence of an appropriate response within a given time, the control computer returns to standby mode.

The invention claimed is:

1. A system for controlling an opening of an openable body section of a vehicle, the system comprising:

a housing, a handle that can be moved relative to the housing, an electric motor, and a computer in communication with the electric motor and that is configured to switch from a standby mode to an active mode;

wherein the electric motor is designed to generate a wake-up voltage when the handle is moved relative to the housing, the computer being configured so as to switch from a standby mode to an active mode when the computer receives the wake-up voltage generated by the motor.

2. The system as set forth in claim 1, wherein the computer is configured to wake up when the wake-up voltage generated by the motor exceeds a threshold.

3. The system as set forth in claim 2, wherein the threshold is less than or equal to 20 mV or 5 mV.

4. The system as set forth in claim 1, wherein the system comprises a voltage rectifier to rectify voltage produced by the motor.

5. The system as set forth in claim 1, wherein the computer comprises one or more of an electric filter that is designed to filter the wake-up voltage coming from the motor or a voltage amplifier that is designed to amplify the wake-up voltage coming from the motor.

6. The system as set forth in claim 1, wherein the computer is configured so as to control the power supply of the motor so that the motor provides mechanical work.

7. The system as set forth in claim 1, wherein the motor is designed to move the handle relative to the housing.

8. The system as set forth in claim 7 wherein the motor is designed to move the handle relative to the housing between a retracted position and an extended position.

9. The system as set forth in claim 1, wherein the motor is designed to generate a wake-up voltage when the handle is pushed toward the housing and/or moved away from the housing.

10. The system as set forth in claim 1, wherein the motor comprises an electromagnetic coil and a permanent magnet that can be moved relative to one another.

11. A vehicle comprising an openable body section with a handle and a system for controlling an opening of the openable body section, the system comprising:

a housing a handle that can be moved relative to the housing, an electric motor, and a computer in communication with the electric motor and that is configured to switch from a standby mode to an active mode;

wherein the electric motor is designed to generate a wake-up voltage when the handle is moved relative to the housing, the computer being configured so as to switch from a standby mode to an active mode when the computer receives the wake-up voltage generated by the motor;

the vehicle further comprising a master computer that communicates with the computer of the system for controlling the opening of the openable body section when the system for controlling the opening of the openable body section is active.

* * * * *